United States Patent [19]

Barfield et al.

[11] Patent Number: 4,552,004

[45] Date of Patent: Nov. 12, 1985

[54] APPARATUS FOR FORMING GOLF BALL MOLDS

[76] Inventors: Gilbert Barfield, 745 Carroll Street, Perry, Ga. 31069; Gary J. Hagopian, 32 Brookmont Drive, Wilbraham, Mass. 01095

[21] Appl. No.: 557,113

[22] Filed: Dec. 1, 1983

[51] Int. Cl.[4] ..... B21D 22/00

[52] U.S. Cl. ..... 72/60; 72/345; 72/465

[58] Field of Search ..... 72/60, 344, 345, 358, 72/359, 360, 465

[56] References Cited

U.S. PATENT DOCUMENTS

| | | | |
|---|---|---|---|
| 2,390,803 | 12/1945 | Marschner . | |
| 2,722,038 | 11/1955 | Freund . | |
| 3,183,696 | 5/1965 | Way et al. . | |
| 3,543,380 | 12/1970 | Hagopian . | |
| 3,831,423 | 8/1974 | Brown et al. . | |
| 3,867,078 | 2/1975 | Porter . | |
| 3,910,095 | 10/1975 | Hartey | 72/345 |
| 4,111,024 | 9/1978 | Dahlman . | |
| 4,130,623 | 12/1978 | Walter . | |
| 4,162,625 | 7/1979 | Simmons . | |

*Primary Examiner*—Leon Gilden

*Attorney, Agent, or Firm*—Donald S. Holland

[57] ABSTRACT

A method and apparatus for making golf ball molds is disclosed. The molds are made by placing a smooth, hemispherical metal cup on top of a dimpled, hemispherical master mold, which is the upper end of a bullet-shaped mounting post. The post is fixed in an upright position to the lower half of a hydraulic press.

Above the post is a vertically movable upper press half with a urethane insert. The insert has a smooth hemispherical recess or cavity that is designed in size and shape to blanket the top surface of the cup when the press halves are pushed together.

When the press halves are pushed together, the urethane insert covers the cup and pushes against it with extreme force. The insert serves basically as a hydraulic fluid and transforms the linear forces produced by the hydraulic press into a uniform pressure acting equally in all directions against the cup.

Due to the tremendous pressure exerted by the press, the insert forces the metal cup to assume the dimpled shape of the underlying master mold. Afterwards, the press halves are moved apart and the cup is then stripped from the master, with the resulting product basically being an exact replica of the master mold.

16 Claims, 13 Drawing Figures

APPARATUS FOR FORMING GOLF BALL MOLDS

BACKGROUND OF THE INVENTION

The present invention relates to the manufacture of golf balls and more particularly to the formation of molds used in producing the balls.

Golf ball molds are used to manufacture the dimpled covers for both two-piece golf balls, i.e., the type having only a solid core and the outer cover, and three-piece balls, i.e., the type having a similar core but with elastic windings around it. Normally, two oppositely facing molds (an upper and a lower) are used to make the dimpled cover with each mold having a hemispherical, dimpled mold cavity that is generally the size of one-half the "finished" ball. When the two molds or mold "halves" are mated, they form a generally spherical interior with a dimpled contour that is basically a negative image of the golf ball cover that will be produced inside of it.

One method of making golf balls is to utilize oppositely facing hemispherical, dimpled shells in an injection molding process. Instead of the mold halves being unitarily formed with hemispherical, dimpled cavities, the shells are separately formed and are later fixed inside the halves. With this injection molding process, the mold halves (and attached shells) are initially moved apart to accept the center core of a golf ball. Afterwards, the mold halves are pushed together to form a spherical housing for the center core, and two pins in the bottom half extend upwardly and lift the ball's core to the center of the mold cavity. Then, the molten material for the ball's outer shell is injected into the cavity around the raised core.

Recent studies conducted by the manufacturers of golf balls have indicated a definite need for accuracy and consistency on the physical measurements of the dimples on golf balls as well as a need to produce complicated and exotic dimple shapes and patterns. These conclusions are the results of performance and wind tunnel testing.

Since the golf ball receives its dimple impressions from the golf ball mold, the integrity of the dimples will be dependent upon the accuracy of the molds used. Accordingly, it is extremely important that an improved process be developed for accurately making consistently-shaped, well-formed golf ball molds. Further, it would be ideal if the process were inexpensive.

In recent history, golf ball molds have been made by hobbing, as described in U.S. Pat. No. 3,831,423, or by die forming, as described in U.S. Pat. No. 3,543,380. The advantage of hobbing is that a metal is forced to conform to a very accurately machined master or hob. Thus, the dimples or indentations on the mold are an accurate replica of the hob. The disadvantage of hobbing is that the metal used to make the mold must be very soft in order to "flow" enough to adequately conform to the hob. The resulting mold from the hobbing process has a short useful life because it is subjected to considerable loads in the manufacture of golf balls and, being very soft, is susceptible to deformation and damage.

The die-forming process described in U.S. Pat. No. 3,543,380 has the advantage of using harder material, including stainless steel, to construct the mold. However, the dimples formed are less accurate than with a hobbing process and are subject to variation from mold to mold.

Accordingly, it is the primary object of the present invention to provide an improved method and apparatus for making extremely accurate golf ball molds.

It is another primary object to provide an improved method and apparatus for making accurately formed, dimpled hemispherical shells for use in golf ball molds.

It is another general object to provide an improved method and apparatus for making accurately machined mold shells that are durable and substantially duplicative of one another.

It is a specific object to provide an improved method of exactly duplicating a master die or hob while still allowing the use of durable construction materials for the mold.

It is a more specific object to provide a method and apparatus of making mold shells in which the shell product is substantially an exact negative of the dimpled master and an exact duplicate of every other shell produced on that master, thus giving the advantages of the hobbing process described in U.S. Pat. No. 3,831,423. However, in this improved method, harder materials can be used than previously found in hobbing, thus giving the "durability" advantages of molds made with the die-forming process described in U.S. Pat. No. 3,543,380.

It is another object to provide method and apparatus, commensurate with the above-listed objects, that are easy to operate, require little operating training and are therefore economical to use.

The above and other objects and advantages of this invention will become more readily apparent when the following description is read in conjunction with the accompanying drawings.

SUMMARY OF THE INVENTION

Figure 1:
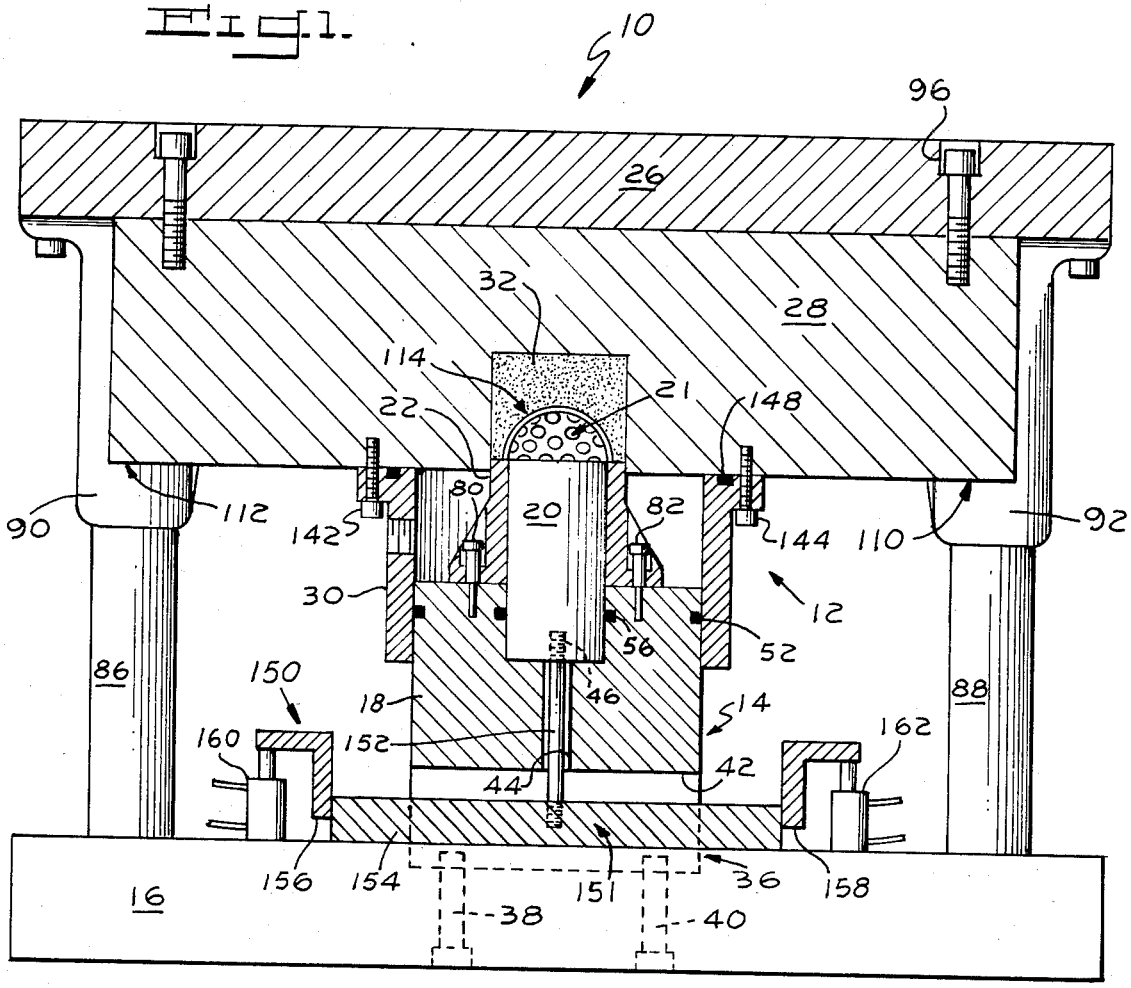
FIG. 1 is an elevational view, partly in cross-section, of an apparatus constructed in accordance with the present invention.
Figure 2:
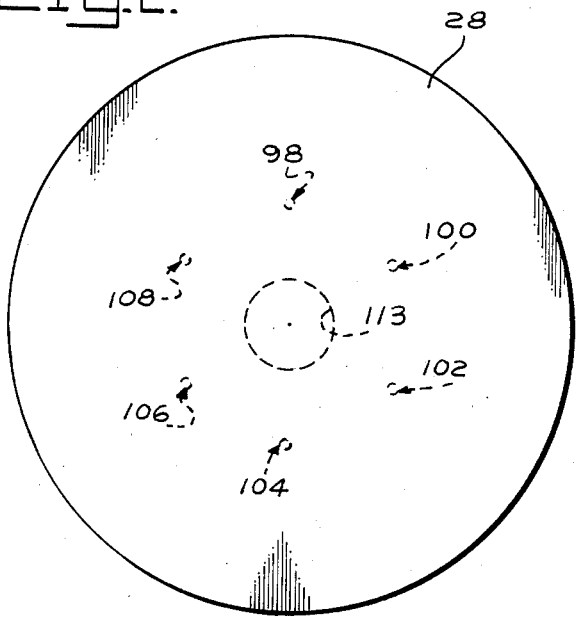
FIG. 2 is a top plan view of an entire annular "hulk" previously shown in cross-section in FIG. 1.

As described more fully in the detailed description that follows, a method and apparatus for making the dimpled shells for golf ball molds is disclosed. The shells are made by placing a smooth, hemispherical metal cup on top of a dimpled, hemispherical master mold, which is the upper end of a mounting post. The post is supported in an upright position by a pedestal attached to the lower half of a hydraulic press.

Above the lower press half is a vertically movable upper press half having an attached "hulk" member on its underside with a central cavity that opens or faces toward the pedestal. The cavity is designed in size and shape to mate with the pedestal when the upper and lower press halves are pushed together by the hydraulic press.

Inside the cavity of the "hulk" member is a urethane insert with a hemispherical recess that is sized and positioned to closely cover the cup when the press halves are pushed together.

As the press halves are moved toward one another and the interior wall of the insert's recess moves against the cup, the hard urethane is under such tremendous pressure that it seeks to extrude in every direction. This extruding material forces against the smooth cup and causes the cup's metal to flow into the dimples of the underlying master mold, thus causing the cup to become substantially a mirror image of the master, with "perfectly" formed dimples.

Due to the extent of the pressure involved, the cups are extremely accurate replicas of the dimpled master mold. Further, the extreme pressure permits hard materials, such as stainless steel, to be used. Despite their hardness, the pressure causes the cups to accurately conform to the shape of the master. Further, since the formed cups are made of hard materials, they are extremely durable to use.

DETAILED DESCRIPTION OF THE PREFERRED EMBODIMENT

Referring to the drawings in detail, an apparatus for making golf ball molds is disclosed and generally designated by the reference numeral 10. This apparatus, affectionately known as the Incredible Hulk TM, has top and bottom portions 12, 14 that are respectively attached to the upper and lower halves of a hydraulic press (not shown) for movement toward one another.

As best shown in FIG. 1, the bottom portion 14 of the apparatus basically comprises a die set base 16 to which an upstanding pedestal 18 is fixedly attached; a bullet-shaped mounting post 20 supported within the pedestal so that it extends beyond the pedestal in an upright position, wherein the upper end of the post provides a dimpled master mold 21 or "dimple" post for cold working or hobbing a mold shell; and, a spring-biased stripper ring 22 that surrounds a portion of the post extension so as to provide a means for removing a finished mold shell, such as that shown at 24. The top portion 12 of the apparatus 10 includes an upper press half having a die set 26 to which an annular "hulk" member 28 is attached so that the hulk's underside faces the master mold 21; a vacuum flange 30 is attached to the hulk 28 for mating with the pedestal 18 when the press halves are moved together; and, an insert 32 housed within the hulk and within the annular boundary of the flange, wherein the insert has a hemispherical recess for surrounding the master mold 21 and any metal cup that is to be formed, which is placed on top of the master.

As best shown in FIGS. 1 and 8–10, pedestal 18 has a generally right-cylindrical surface 34, the lower portion of which fits into an annular recess 36 in die set base 16. The pedestal is preferably made of steel and is removably, but securely, attached to the die set by any suitable means, such as the bolts shown at 38, 40.

Moving from its bottom to top, pedestal 18 includes a thin channel or longitudinal slot 42 which communicates with a perpendicular, upstanding channel 44 to form an upside-down "T". The longitudinal portion 42 acts as a guide for a vertically movable mechanical linkage 150, disclosed more fully below, and the upstanding channel 44 allows the admittance of a stud's threaded end 46 for removably attaching the mounting post 20 to the linkage. The stud secures the mounting post 20 inside a right-cylindrical cavity 48 in the top of pedestal 18.

Also at the top of the pedestal is an annular groove 50 on the outside surface 34 for housing an "O" ring 52, an inner annular groove 54 located in the sidewall of cavity 48 for housing another "O" ring 56, and a pair of "threaded" bores 58, 60 for mounting the stripper ring atop the pedestal.

Figure 5:
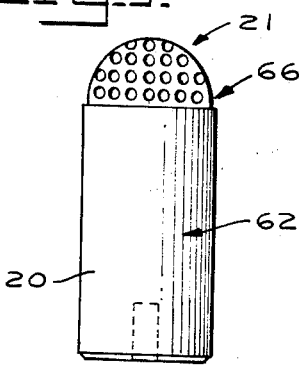
FIG. 5 is an elevational view of a dimpled master or "dimple" post shown in FIG. 1.

Mounting post 20 fits within the pedestal's recess 48 and is supported in an unwavering, upright position by "O" ring 56 that grips the side of the post and bolt 46. The post 20 is preferably made of steel and, as shown in both FIGS. 1 and 5, is generally solid and bullet shaped. It has a lower portion in the form of a right cylinder 62, much like the casing of a bullet's cartridge, and a rounded, slightly hemispherical upper end that resembles the projectile portion of the cartridge.

Upper end of the post 20 is carefully machined to closely resemble half of the outer cover of a "finished" golf ball. It can be used in this apparatus as a dimpled master mold or "dimple" post 21. Before being used as a master, the accuracy of the sizing and spacing of the dimples is closely reviewed.

Figure 7:
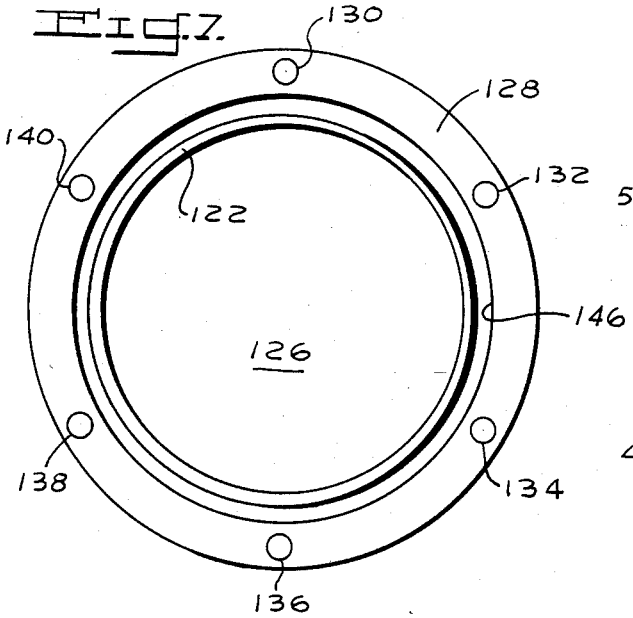
FIG. 7 is a top plan view of the entire vacuum flange.
Figure 8:
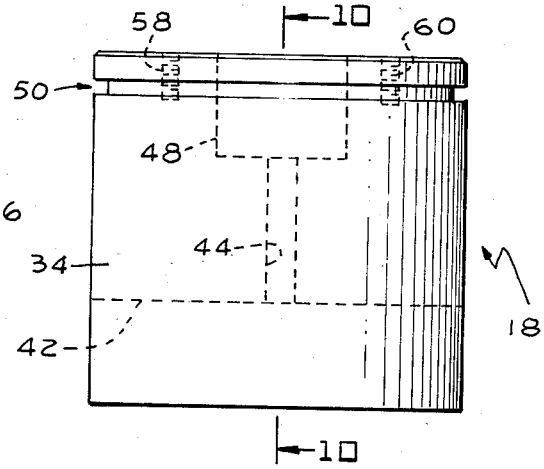
FIG. 8 is a side elevational view of an entire base previously shown in cross-section in FIG. 1.
Figure 9:
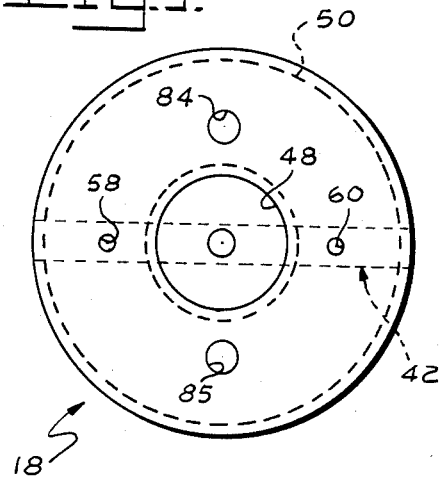
FIG. 9 is a top plan view of the base.
Figure 10:
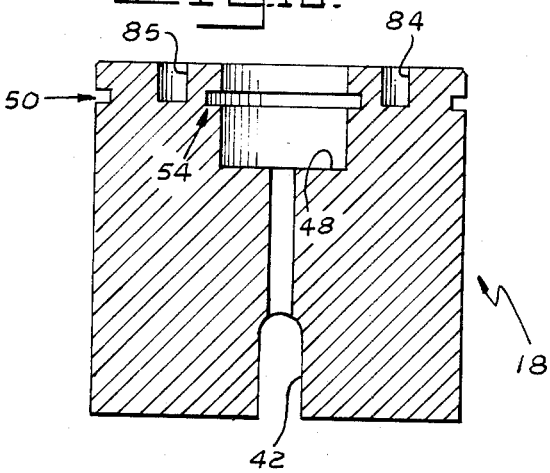
FIG. 10 is a cross-sectional view of the base taken along line 10—10 of FIG. 9.
Figure 11:
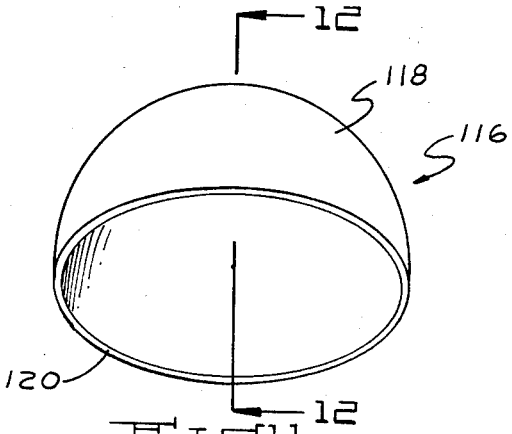
FIG. 11 is a perspective view of a smooth hemispherical cup that can be transformed by the present invention into a "finished" dimpled shell for golf ball molds.
Figure 12:
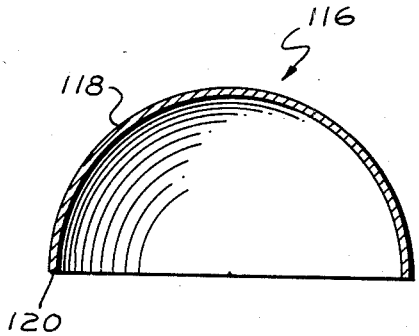
FIG. 12 is a cross-sectional view of the cup taken along line 12—12 of FIG. 11; and, FIG. 13 is an elevational view of a finished shell.
Figure 13:
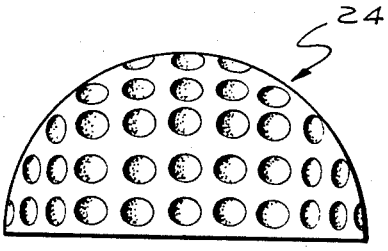

As best shown in FIG. 7, the upper end or "master mold" has a diameter slightly less than the integral right cylindrical portion 62 of post 20. There is therefore a step 66 between the outside of the right cylinder and the mold's bottom which provides a slight shoulder for the work piece being formed.

Figure 3:
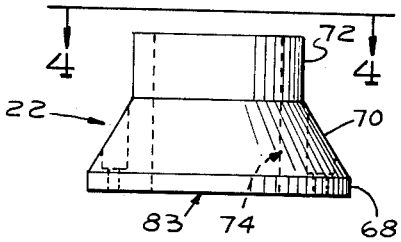
FIG. 3 is a side elevational view of an entire stripper ring previously shown in cross-section in FIG. 1.

When the apparatus is assembled, stripper ring 22 is fixed to the top of pedestal 18 so that its center surrounds the post 20 but permits the "master" top 21 to extend beyond it. As best shown in FIG. 3, the stripper ring resembles the base and dado of a Roman column or the shape of a modern hood for an open-hearth fireplace. It is preferably made of steel and includes a lower rim 68, a frustoconical midsection 70 and a right-cylindrical top 72. Inside of the ring is a central, upstanding passageway 74 through which the right cylindrical portion 62 of the mounting post 18 extends. This passageway is a right cylinder and has a diameter close to that of the mounting post.

Figure 4:
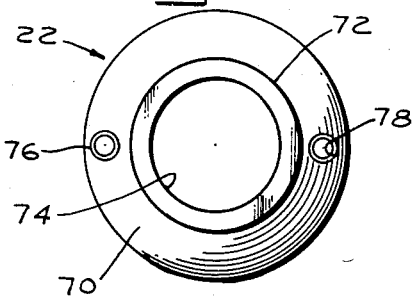
FIG. 4 is a top plan view of the stripper ring taken along line 4—4 of FIG. 3.

Referring to FIGS. 3 and 4, the stripper ring includes two upstanding, stepped through bores 76, 78, approximately 180° apart, for attaching the ring to the pedestal. When the apparatus is assembled (see FIG. 1), shouldered stripper bolts 80, 82 fit through the bores 76, 78 and are threaded into bores 58, 60 of pedestal 18. They attach the ring to the top of the pedestal but permit a limited amount of vertical travel of the ring away from the pedestal.

Each stripper bolt 80, 82 has a smooth midsection with a constant diameter and a top shoulder or head. Since the through bores 76, 78 of the stripper ring are slightly larger than the bolts' midsections but smaller than the bolts' heads, the ring is free to travel in an upward direction, away from the pedestal, until the heads of the bolts hit the top of the lower rim 68. The heads then act as stops and prevent further movement.

Between the bottom 83 of the stripper ring and the top of the pedestal are located a plurality of coiled stripper springs (not shown for the sake of simplicity in the drawings). These springs serve to push the ring away from the pedestal when the upper and lower press halves are pulled apart. In the preferred embodiment, there are two springs located in wells 84, 85 in the pedestal's top. These wells are located below the stripper ring at 12 o'clock and 6 o'clock relative to FIG. 4.

When the two press halves are moved toward one another, the elements of the lower portion of the apparatus (die set base 16, mounting post 20, and stripper ring 22) move in unison. They are guided toward the upper apparatus portion 12 by guide posts 86, 88 (attached to die set base 16) that slide through respective bosses 90, 92 that are bolted to the upper die set 26.

As best shown in FIGS. 1, 2, 6 and 7, the upper portion 12 of the apparatus 10 includes an annular die set 26 having four radially spaced, counterbored holes (two shown at 94, 96). Bolts are fitted through these bores and threaded into registered holes 98, 100, 102, 104, 106, 108 in the top of the "hulk" member 28 to removably, but firmly, attach the hulk to the underside of the die set.

Hulk 28 is an annular member that is preferably made of preheated, treated steel. Besides being attached to the upper die set by bolts, it is also secured to the upper set by supporting shoulders 110, 112 of guide bosses 90, 92.

On the underside of the hulk 28 (as viewed in FIG. 1), there is a central cylindrical recess 113 for housing the insert 32. The insert is preferably made of urethane and includes a smooth, hemispherical cavity 114 that is similarly shaped but slightly larger than the diameter of the dimpled master mold 21. The space between the inner walls of the cavity and the surface of the master mold allows a smooth, generally hemispherical shell or cup 116 (see FIG. 10), preferably consisting of a hemispherical dome 118, to be placed on top of the dimpled master 21 so that the cup's interior cavity straddles the master. When the apparatus 10 is in its FIG. 1 position during mold forming, the lower edge 120 of the cup 116 rests on both the shoulder 66 and stripper ring 22, and its dome 118 closely covers the master.

Though the thickness of edge 120 is sufficient to support the cup on top of the ring, the cup 116 can alternatively be derby shaped (not shown). In that embodiment, an annular flange extends from edge 120 and aids in supporting the cup.

Figure 6:
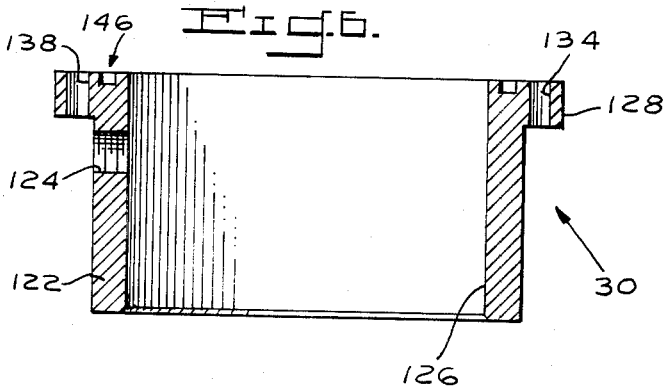
FIG. 6 is an enlarged view of the vacuum flange shown in FIG. 1, with both views showing the flange in cross-section.

Vacuum flange 30 extends downwardly from the hulk 28 and is designed to closely surround the pedestal 18 as the top and bottom apparatus portions 12, 14 are moved toward one another. As best shown in FIGS. 6 and 7, the vacuum flange 30 is annular and has a hollow right-cylindrical portion 122 with a discharge outlet or bore 124 for evacuating air from the flange's interior cavity 126 when the pedestal and flange mate and close together. The vacuum flange is made of any suitable hard material, such as metal, and includes an upper lip 128 with six radially spaced holes 130, 132, 134, 136, 138, 140 for removably, but securely, attaching the flange to the underside of hulk 28 via six bolts (two shown at 142, 144 in FIG. 1). Further, the upper lip has an annular groove 146, spaced inwardly from the rim of the lip 118, for housing an "O" ring 148.

In operation, the present apparatus is used to form a finished mold shell in the following manner:

First, the upper and lower halves of the press are moved apart until the top and bottom portions 12, 14 of the apparatus separate sufficiently to allow the "raw" or smooth shell 116 to be placed on top of the dimpled master 21. In the "open" position, the stripper ring 22 is lifted from the pedestal 18 by the coiled springs (not shown) a distance which is restricted by the stripper bolts 80, 82. The smooth hemispherical shell is placed over the master 21 and rests atop the stripper ring. The stripper ring does not allow the shell to contact the master in this position. When the press halves close together, the pedestal 18 enters the vacuum flange 30 and a vacuum is pulled through discharge outlet 124 by a vacuum pump (not shown) to evacuate air which might otherwise inhibit proper dimple forming. As closing continues, the smooth hemispherical shell contacts the urethane insert 32 and pushes the stripper ring 22 down by overcoming the biasing force of the aforementioned springs. The shell dome 120 then makes contact with the dimpled master 21.

The stripper ring's leading edge enters the hulk's recess 36 and seals the ring and recess due to the fit of the two parts. The stripper ring 22 and the master or upper post end 21 push against the urethane insert creating pressure inside the hulk's recess 36. The urethane insert 32 basically serves as a hydraulic fluid and transforms the linear forces produced by the hydraulic press to a uniform pressure acting equally in all directions inside the recess 36 or pressure chamber.

When the pressure reaches an adequate level, the smooth hemispherical shell 116 is forced to take the shape of the dimpled master 21. The die halves are then moved apart to completely separate the top and bottom portions 12, 14 of the apparatus 10.

Next, the dimpled master 21 is raised away from the top of pedestal 18 by the mechanical linkage 150 which is connected to the mounting post 20 through the channel 44 in pedestal 18. The linkage lifts the mounting post 20 until the stripper ring 22 is fully biased away from the pedestal by the stripper springs (as far as the shoulders of stripper bolts 80, 82 will permit) and the bottom of the finished shell is located slightly above the top of the extended ring.

Though any suitable linkage could be used, the preferred linkage 150 is an upside-down, T-shaped member 151 having its stem 152 slidably located inside the upstanding channel 44 and its horizontal portion 154 located inside the longitudinally extending slot 42 (see FIG. 1).

In the preferred embodiment, the stem 152 is a stud that is longer than channel 44. It is fixedly attached at its upper end via a threaded portion 46 that screws into the bottom of post 20. The stud is similarly attached at its lower end to the horizontal portion 154 via another threaded portion.

As best shown in FIG. 1, the horizontal portion 154 of T-member 151 is a bar that is shorter than the longitudinally extending slot 42. Its ends extend beyond the slot 42 where they are fixedly connected by L-shaped members 156, 158 to the vertically extending piston arms of air cylinders 160, 162. By selectively extending and retracting the cylinder's piston arms, the T-member 151 can be selectively raised or lowered to move the attached mounting post 20 toward or away from the pedestal 18 top.

After the dimpled shell has been raised above the extended stripper ring, the shell is heated and expanded by any suitable means, such as the means shown in U.S. Pat. No. 3,867,078 or an induction heater coil (not shown) that is moved over the post. After the shell has adequately expanded, the piston arms are rapidly retracted. As the arms retract, the T-member 151 carries the post 20 downwardly and initially lowers the shell's lip 120 against the top of the stripper ring 22. As the arms continue to retract, the post moves downwardly and forces the ring to move with it until the coiled stripper springs compress enough to overcome the downward force and push the ring upwards, thus lifting the finished shell off the dimpled master 21.

The shell can then be removed for further processing, such as polishing and cutting. For example, the outer diameter of its lower edge 120 can be cut back to provide a stepped outer surface or recessed rim for mating with an oppositely facing shell during golf ball molding.

The pressure required during this process to form the finished shell to an exact "negative" of the dimpled master is, of course, dependent on the hardness and thickness of the shell. Generally, the required pressure will be in excess of 100,000 p.s.i.

It will be readily understood by those skilled in the art that obvious modifications can be made to both the aforementioned apparatus and method without departing from the spirit or scope of the present invention. For example, the urethane insert 32 could be made of any suitable elastomer. Accordingly, reference should be made primarily to the appended claims, rather than the foregoing specification, to determine the scope of the invention.

Having thus described the invention, what is claimed is:

1. An apparatus for making dimpled shells for golf ball molds, wherein the apparatus comprises:

(a) top and bottom portions that are adapted to be respectively attached to the upper and lower halves of a hydraulic press for movement toward or away from one another;

(b) said bottom apparatus portion comprising:

(i) a lower die set base to which an upstanding pedestal is fixedly attached;

(ii) a bullet-shaped mounting post fixedly supported by the pedestal so that it extends from the top of the pedestal in an upright position, wherein the upper end of the post comprises a hemispherical, dimpled master mold for cold working a dimpled mold shell from a smooth hemispherical metal cup placed on top of the master;

(iii) means for removing a finished mold shell from atop the master, said means comprising a spring-biased stripper ring that is attached to the top of the pedestal and which surrounds at least a mid-section of the post, wherein said ring is biased away from the top of the pedestal by springs located between it and the pedestal, and its upward travel away from the pedestal is limited by stop members that attach the stripper ring to the pedestal; and, (c) said top apparatus portion comprising:

(i) an upper die set having a hulk member attached to its underside, wherein said member includes a cavity that faces the post and is complementarily shaped to it for a close mating of the post and cavity when the top and bottom apparatus portions are pushed toward one another;

(ii) a vacuum flange attached to the hulk for mating with the pedestal when the press halves are moved together, wherein the flange has a hollow cylindrical portion that extends from the hulk, surrounds the hulk's cavity, and has an inner surface that is complementarily shaped and sized with the periphery of the top of the pedestal; and, (iii) an insert housed within the hulk's cavity and within the boundary of the flange, wherein the insert has a hemispherical recess for surrounding the master mold and the hemispherical cup placed on top of the master.

2. The apparatus of claim 1 wherein the insert is made of urethane.

3. The apparatus of claim 2 wherein the stripper ring is biased away from the pedestal by a plurality of coiled springs housed in wells in the top of the pedestal.

4. The apparatus of claim 3 wherein the stripper ring has an upper surface that supports the hemispherical shell on top of it.

5. The apparatus of claim 4 wherein the vacuum flange resembles a stove-top hat, with a rim for attaching it to the underside of the hulk member and the hollow cylindrical portion is in the form of a right cylinder.

6. The apparatus of claim 5 wherein the cylindrical portion of the vacuum flange has a discharge outlet for evacuating air from within the flange during mating of the pedestal and flange.

7. The apparatus of claim 1 wherein the bullet-shaped mounting post comprises a right-cylindrical portion attached to the hemispherical, dimpled master.

8. The apparatus of claim 7 wherein the hulk's cavity is generally a right cylinder with a diameter slightly larger, but substantially equal to the diameter of the right-cylindrical portion of the mounting post.

9. An apparatus for making golf ball molds, comprising:

(a) top and bottom portions that are adapted to be respectively attached to the upper and lower halves of a hydraulic press for movement toward or away from one another;

(b) said bottom apparatus portion comprising:

(i) an upstanding pedestal with a recess in its top;

(ii) a bullet-shaped mounting post fixedly mounted within the recess so that it extends from the top of the pedestal in an upright position, wherein the upper end of the post comprises a hemispherical, dimpled master mold for cold working a dimpled mold shell from a smooth hemispherical metal cup placed on top of the master;

(iii) means for removing a finished mold shell from atop the master, said means comprising a spring-biased stripper ring that is attached to the top of the pedestal and which surrounds at least a mid-section of the post, wherein said ring is biased away from the top of the pedestal by springs located between it and the pedestal, and its upward travel away from the pedestal is limited by stop members that attach the stripper ring to the pedestal; and, (c) said top apparatus portion comprising:

(i) an upper member with a cavity that opens toward the post and is complementarily shaped to it for a close mating of the post and cavity when the top and bottom apparatus portions are pushed toward one another;

(ii) a vacuum flange attached to the hulk for mating with the pedestal when the press halves are moved together, wherein the flange has a hollow cylindrical portion that extends from the hulk, surrounds the hulk's cavity, and has an inner surface that is complementarily shaped and sized with the periphery of the top of the pedestal; and, (iii) an insert housed within the hulk's cavity and within the boundary of the flange, wherein the insert has a hemispherical recess for surrounding the master mold and the hemispherical cup placed on top of the master.

10. The apparatus of claim 9 wherein the insert is made of urethane.

11. The apparatus of claim 10 wherein the stripper ring is biased away from the pedestal by a plurality of coiled springs housed in wells in the top of the pedestal.

12. The apparatus of claim 11 wherein the stripper ring has an upper surface that supports the hemispherical shell on top of it.

13. The apparatus of claim 12 wherein the vacuum flange resembles a stove-top hat, with a rim for attaching it to the underside of the hulk member and the hollow cylindrical portion is in the form of a right cylinder.

14. The apparatus of claim 13 wherein the cylindrical portion of the vacuum flange has a discharge outlet for evacuating air from within the flange during mating of the pedestal and flange.

15. The apparatus of claim 9 wherein the bullet-shaped mounting post comprises a right-cylindrical portion attached to the hemispherical, dimpled master.

16. The apparatus of claim 15 wherein the hulk's cavity is generally a right cylinder with a diameter slightly larger, but substantially equal to the diameter of the right-cylindrical portion of the mounting post.

* * * * *